US005328439A

United States Patent [19]

Goldberg

[11] Patent Number: 5,328,439

[45] Date of Patent: Jul. 12, 1994

[54] SAFETY FRINGE FOR PAPER

[76] Inventor: Robert M. Goldberg, 120 Orleans La., Jericho, N.Y. 11753

[21] Appl. No.: 4,296

[22] Filed: Jan. 14, 1993

[51] Int. Cl.[5] ..... B31D 1/00

[52] U.S. Cl. ..... 493/467; 493/480

[58] Field of Search ..... 493/464, 467, 480

[56] References Cited

U.S. PATENT DOCUMENTS

| | | | |
|---|---|---|---|
| 42,510 | 4/1864 | Robjohn . | |
| 219,464 | 9/1879 | Hake . | |
| 221,933 | 11/1879 | Oechsli . | |
| 439,058 | 10/1890 | Fiala . | |
| 638,361 | 12/1899 | Schumann | 493/464 |
| 711,840 | 10/1902 | Fernald . | |
| 1,362,689 | 12/1920 | Higgons . | |
| 1,748,389 | 8/1930 | Marcel . | |
| 1,865,459 | 11/1932 | Edmands . | |
| 1,939,571 | 12/1933 | Rau | 493/464 |
| 2,020,668 | 3/1935 | Wandel | 154/2 |
| 2,168,895 | 7/1939 | Asnes | 154/33 |
| 2,874,618 | 2/1959 | Yang | 92/70 |
| 3,352,738 | 11/1967 | Doll | 493/464 |

*Primary Examiner*—Jack Lavinder

[57] ABSTRACT

A safety fringe is formed around the edge of paper products in order to reduce the likelihood of people receiving cuts. A softened and weakened fringe is formed by pressing a hard-surfaced mechanical member against a narrow strip near the edge of the paper. Many commonly-available machine parts are suitable for this purpose. A safety fringe can be formed at the mill or at any other stage in the processing or handling of paper.

12 Claims, 4 Drawing Sheets

Fig. 1
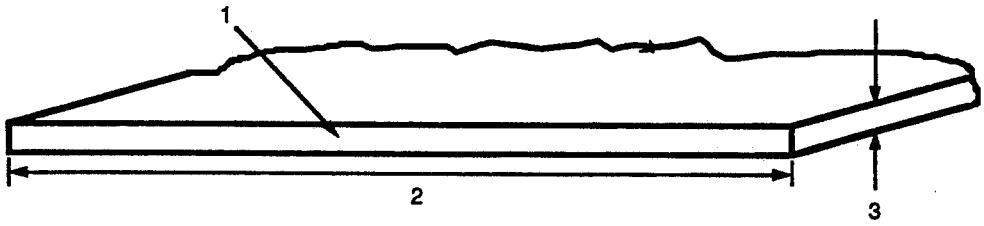
Fig. 2
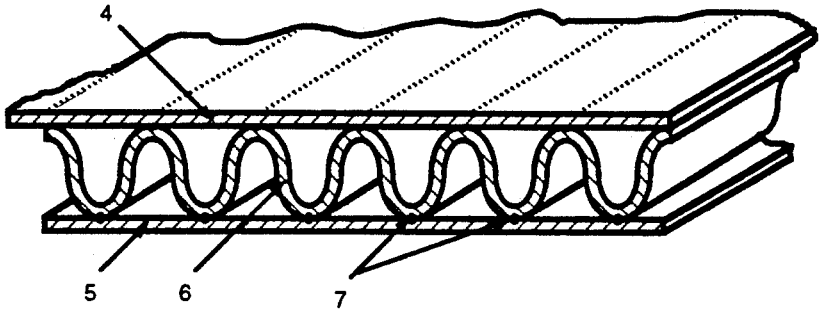
Fig. 3a
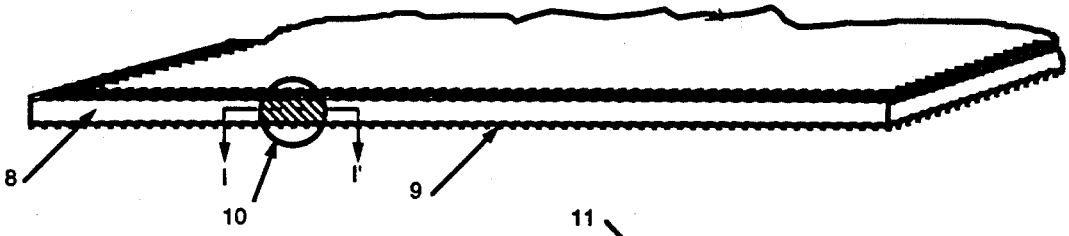
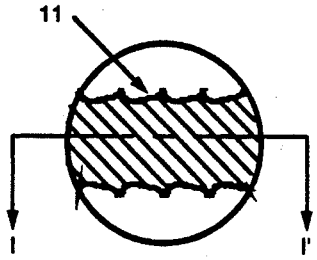
Fig 3b

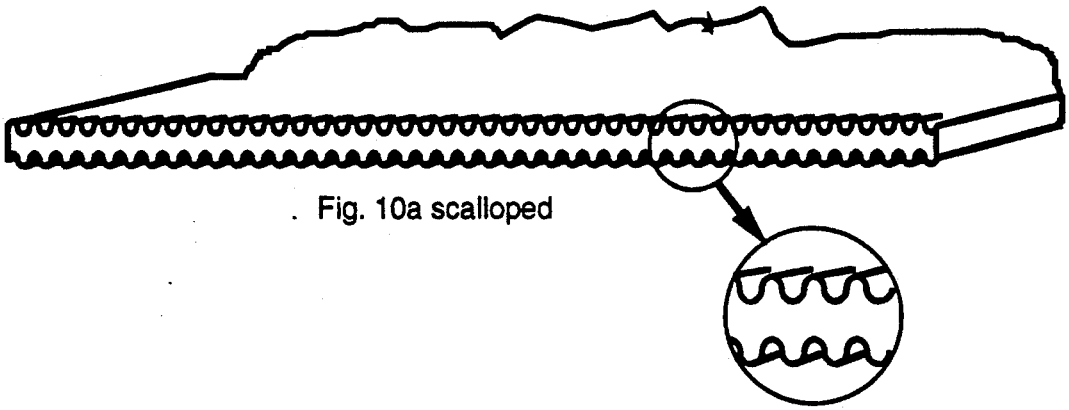
Fig. 10a scalloped
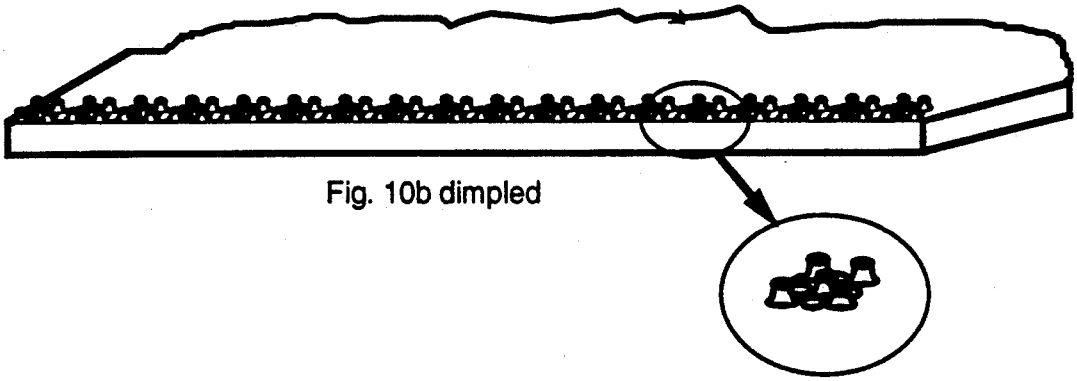
Fig. 10b dimpled
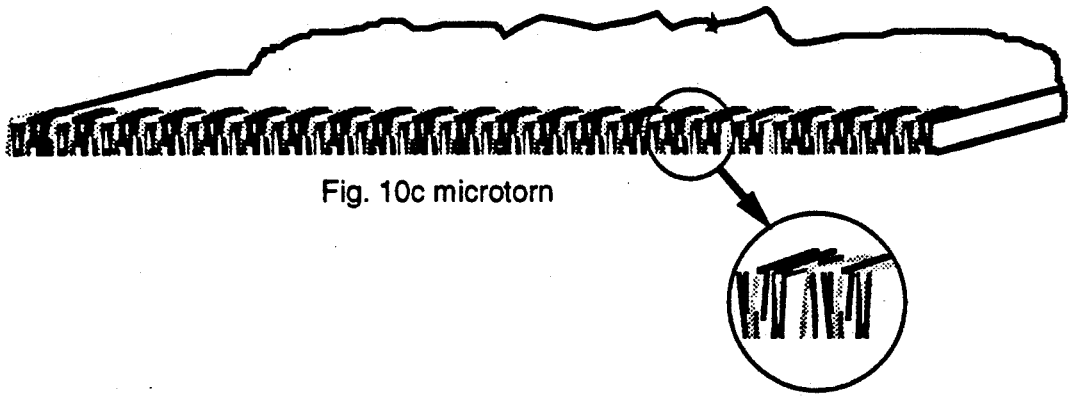
Fig. 10c microtorn
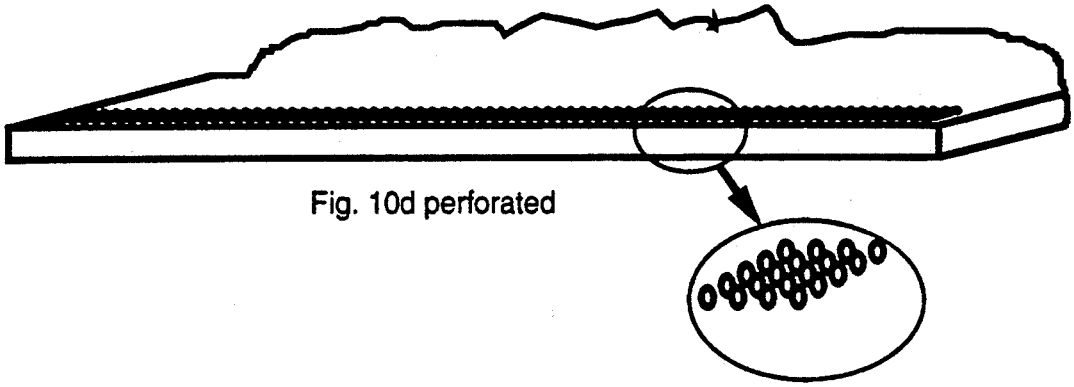
Fig. 10d perforated

SAFETY FRINGE FOR PAPER

SHORT DESCRIPTION OF THE INVENTION

The invention relates generally to paper and paper products, and particularly, to an improved safety feature and method of such products and their manufacture and use.

BACKGROUND OF THE INVENTION

Many of us are all too familiar with having cut our finger on the sharp edge of paper or a paper product, such as cardboard, corrugated paperboard, a sheet of writing paper, etc. For example, as one might run one's finger underneath a sealed envelope to open it, the sharp edges on the flap, as it is being torn open, sometimes tears into the finger, causing a painful, sometimes bleeding cut that is prone to infection. Some grades of paper are so sharp along the edge, that many persons accidentally cut themselves when routinely handling the paper in normal use. This is often the case, with containers and packaging, when persons pack and seal, open and unpack paper-based materials.

There are other materials, similar to paper, where cuts occur when persons contact the material. While what follows applies primarily to paper products, the invention is suitable with other similar material.

The outer layer of human skin is made up of dead cells that are immersed in a matrix of fibrous secretions. A "cut" occurs when the outer layer is torn or slit and the structures below, live cells, lymph, blood vessels, etc., are reached. A cut can occur when an edge of a paper product contacts skin, if the edge is thin enough or sharp enough, relative to skin structure, and if the material behind the edge is stiff enough so sufficient stress can be developed.

These conditions follow from some common observations: while tissue paper is thin, it does not provide enough support for its edge to cut skin; a sheet of writing paper, which might otherwise be able to cause a cut, is unlikely to do so when the paper is crumpled and its edge lacks regularity and stiffness; a cut is more likely to occur when the edge of a sheet of paper slides across, rather than when the same sheet only presses up against the skin; soft paper, particularly paper having short fiber lengths, usually does not have sufficient structural rigidity to tear through skin; stiffer papers with long fiber contents have greater rigidity and are more apt to penetrate the skin.

Two terms commonly used to describe paper are (basis) weight and stiffness. The weight of a paper is its weight in pounds per 1000 square feet (of face area). The specific weight of a sample of the paper would be given as the ratio of basis weight to its thickness. Typical weights are listed below:

| type | weight, lbs | in × in - sheets/ream |
|---|---|---|
| mimeograph paper | 21 | 17 × 22 - 400 |
| newsprint | 32 | 24 × 36 - 500 |
| machine finish book | 48 | 17 × 22 - 500 |
| supercalendered book | 50 | 25 × 38 - 500 |
| coated book | 70 | 25 × 38 - 500 |

The stiffness of paper is directly proportional to the product of Young's modulus (E) and the cross sectional moment of inertia (I), and is inversely proportional to basis weight. Paper is a plastic material and E must be defined within a limited range of applied stress and taking the water content of the sample into account.

Corrugated paperboard products are made up of a plurality of layers of paper. A person handling an edge of any of these layers may be cut. Standard corrugated paperboard consists of various combinations of flat sheets and serpentine (fluted) sheets, of various height and number of flutes/foot, glued together in alternating layers. Corrugated materials in common use are described as follows:

| type | number of flat sheets | number of serpentine sheets |
|---|---|---|
| single face | 1 | 1 |
| double face | 2 | 1 |
| double wall | 3 | 2 |
| triple wall | 4 | 3 |

The sizes of double face corrugated boards that are in common use are as follows:

| size | flutes/foot | height without faces | take-up factor* |
|---|---|---|---|
| A | 36 | 3/16" | 1.58 |
| B | 51 | 3/32" | 1.38 |
| C | 39–42 | 9/64" | 1.5 |
| E | 96 | 3/64" | 1.3 |

*take-up factor is the ratio of the length of paper used in the fluted layer to the given length of board Two general means by which paper and paper products are cut:

1) by drawing a sharp blade across and through the paper, and,
2) by pressing a sharp die against the paper until penetration results in separation.

In either of these cases, the edge of the cutting tool may be straight or serrated (wave). Die-cutting is a considerably more expensive means that is used to obtain parts of complex shape, as well as to obtain dimensional accuracy. One of the things accomplished when paper products are cut with a wave die is that the user is less apt to receive a skin cut when handling the product. Serrated edges are irregular and increase the amount of material which skin might contact, thereby reducing stress. While this method of cutting paper reduces the problem addressed by the present invention, people still receive cuts from the serrated edge of die-cut paper, and die-cutting is not practical for many products where cuts frequently occur.

Additional information about paper can be obtained from the AMERICAN PAPER INSTITUTE, 1250 Connecticut Avenue, N.W., Suite 210, Washington, D.C. 20036. A standard reference is the *HANDBOOK OF PULP AND PAPER TECHNOLOGY*, edited by Kenneth W. Britt, VAN NOSTRAND REINHOLD, 1970.

OBJECT OF THE INVENTION

The object of the invention is to reduce the possibility of paper cuts when persons come into contact with the edge of paper sheets and other paper products.

The present invention is also a method for the manufacture of paper sheets and paper products in which the edge of paper is less likely to cut a person.

Another object is to employ the present method at a later stage in the use of paper and paper products. For example, when a sharp edge is produced after a fresh cutting.

Another object is to apply the method of invention within paper handling equipment, such as: printing presses, copying machines, postage meter, folding machines, box-making machines, cutting machines, and wherever else paper and paper products are manufactured, processed, or used.

Yet another object is to generate equipment for users or handlers of paper products as they feel the need to form a safety fringe on a particular product.

SUMMARY OF THE INVENTION

A process for treating the edge of paper products and thereby reducing the likelihood that a person handling such products will receive a cut. Treatment consists of forming a narrow safety fringe about the edge of paper so it will be softer and too weak to support the stress required to cut skin. A safety fringe can be formed economically with simple mechanical means at various stages in manufacture, or in later processing, or by the end user of the product.

BRIEF DESCRIPTION OF THE DRAWINGS

FIG. 1 is a perspective view of a portion of a sheet of writing paper.

FIG. 2 is a three-dimensional view of a portion of a sheet of corrugated paperboard.

FIG. 3*a* shows the edge of the sheet of paper in FIG. 1 after a typical safety fringe has been formed.

FIG. 3*b* is an enlarged view of the edge of the paper taken at spot I—I' of FIG. 3.

FIG. 10 shows the appearance of several types of safety fringe. a) scalloped, b) dimpled, c) microtorn, d) perforated.

DETAILED DESCRIPTION OF THE PREFERRED EMBODIMENTS

Figure 4:
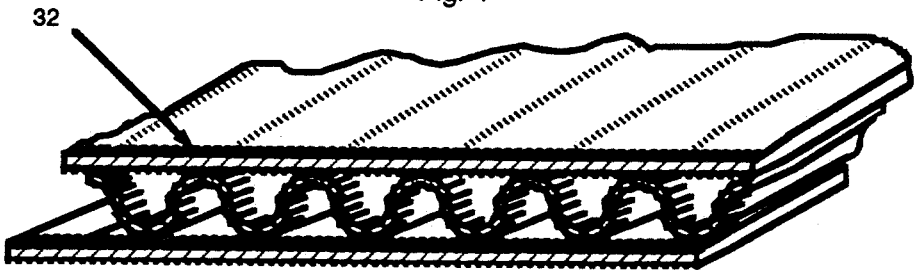
FIG. 4 is an enlarged view of the edge of a double face paperboard sheet after a typical safety fringe has been formed.

Item 1 in FIG. 1 shows the edge of a sheet of paper. The significant dimensions are its width, 2, and its thickness, 3. The table below indicates a range of thicknesses in microns ($10^{-4}$ centimeters) for some types of common paper.

| item | thickness |
|---|---|
| tissue paper (single-ply) | 40 |
| napkin | 50 |
| tabloid newspaper | 80 |
| writing pad, copy paper | 90 |
| envelope | 120 |
| large manila envelope | 190 |
| page of hardcover book | 140 |
| manila file folder | 270 |

The moment of inertia, I, of a sheet of paper with a regular edge, about the centroid through eithr of the principal axes, is, $$I = \frac{\rho w t^3}{12} \text{ or } I = \frac{\rho t w^3}{12}$$

where $\rho$ is basis weight and t and w are the thickness and width of the sheet of paper, respectively.

Depending upon the orientation of the edge of the paper, to the object in contact with it, the moment of inertia, I, that is significant in developing stress, may be very large. This is so even for very thin paper. (The stiffness of paper, as mentioned earlier, is directly proportional to I).

FIG. 2 shows the structure of a sheet of double face corrugated paperboard. The outer layers, 4 and 5, are of heavy paper that is glued along lines shown at 7, that are usually visible in the outer layers, to a serpentine layer of heavy paper, 6. The moment of inertia of the corrugated paperboard sheet is considerably greatly than that of the individual, flat sheets of which it is constituted, since the mass of the paper is distributed away from the principal axes; the sheets are rigidly maintained in relative position by the lines of glue, 7. The edges of the layers of paperboard have the sharpness of the individual layers of paper, but the structure has much greater stiffness. Consequently, paper cuts are a frequent and serious occurrence in the packaging and container industries.

FIG. 3 illustrates a sheet of paper that has been treated, by means recommended in the present invention, to reduce the likelihood that a person handling it will receive a paper cut. The edge of the paper and an area slightly inward from the edge, have a safety fringe of weakened material. The edge of the paper, 8, has been deformed at its top and bottom into the scalloped shape shown in section I—I', at 10. FIG. 3*b* is an enlarged view of the cross section of the paper at spot I—I' of FIG. 3*a*. In this case, a regular undulating (serrated) fringe was formed corresponding to the teeth of a pair of meshing, idler, spur gears through which the edge of the paper was passed.

Such treatment, to form a weakened safety fringe, can be done at the time paper is manufactured or at a later stage in the processing or use of the paper product. Treatment consists of making the edges irregular, less stiff, and/or of weakening the paper immediately behind the edges so as to make the material less stiff and reduce support for the edge.

A safety fringe is narrow and has little effect on the overall structural strength of a product. The width of a fringe should vary with the weight of the paper sheet, typically ranging from about 1/32 of an inch for 20 pound bond paper, to perhaps 3/16" for 200 pound craft paper, such as is commonly used in the layers of corrugated paperboard. Depending upon the use to which the paper will be put and the aesthetic taste of users, the characteristics of the fringe can vary over a wide range of softness, width, and visual appearance.

After a safety fringe is formed, the thickness and regularity of the edges may be significantly different from the thickness and regularity of the rest of the product. This may need to be taken into account where paper is to be further processed in a machine. For example, the irregular edge of a prominent safety fringe might increase the chances of a paper jam in some copy machines. In such cases, a less prominent fringe may be formed, or copier manufacturers will need to take the characteristics of safety fringes into account in their design, or the fringe might be formed at the exit of the copier or after the sheet has been removed from the copier.

A safety fringe is formed by bringing the edges of the paper into contact with hard-surfaced treatment members that mechanically weaken and distort the paper by bending, crushing, micro-tearing, slitting, perforating or otherwise distressing the paper. Where these treatments involve pressing paper against a treatment member, they may be distinguished: as 1) embossing, where a pattern is impressed against the paper without further lateral movement, or 2) flailing, where the pattern of the treatment member is impressed against the paper and there is additional lateral movement between the treatment member and the paper.

FIG. 4 shows a sheet of double face paperboard after fringes have been formed on the three layers of paper of which it is constituted. In this case, the layers were crushed between a mating pair of idler spur gears, as the embossed impressions on the sheet, 32, indicate.

The contacting surfaces of suitable mechanical treatment members can be based on circular, linear, planar, or other convenient geometric shape, as illustrated below, and have either regular or random pattern.

Figure 6:
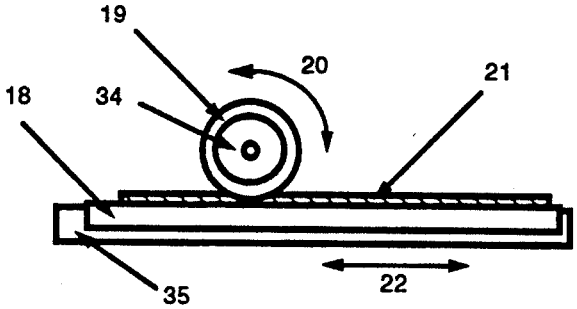
FIG. 6 is a schematic drawing of an alternative apparatus in the method of the invention.

FIG. 6 shows the preferred apparatus of the present invention, consisting of two, rotating circular members, 30 and 31, either one or both of which have hard treatment surfaces, 16 or 17, that comes in contact with the edge of the paper, 12, as it passes between the treatment members. The arrows, 13, 14 and 15, indicate relative motions for the paper and the members. The circular members may be turned by driver means or may be idler parts that turn as a result of contact with the moving paper. The paper may be fed through the circular members by transport means or be driven by the rotation of the driven circular members. In either of these cases, depending on the relative motions of the paper and the treatment surfaces, the pattern of the surface of the member(s) may be embossed on the paper or the paper may be flailed as the treatment surface(s) slide(s) past.

Taking spur gears as the treatment member, for example: heavy papers can be crushed firmly, by gears with relatively, widely-spaced teeth. Finer papers will be lightly crushed by gears having relatively more teeth per inch, so that their fringe will be less obvious.

FIG. 6 shows an alternative apparatus that consists of a rotating circular treatment member, 34, traveling over a planar treatment member, 35, upon which is overlaid the edge of the paper, 21. As with the two circular treatment members previously described, either one or both treatment surfaces, 18 and 19, may have hard surfaces in order to form a fringe, and the relative motions of the paper and the treatment surface(s), indicated by arrows, 20 and 22, will determine whether the safety fringe is embossed or flailed. For example, a simple manual arrangement for forming a safety fringe is shown on a table, 36, in FIG. 7, and comprises a circular treatment member, 40, that is rolled across the edge of a sheet of paper, 38, being treated. The second member is a block of resilient material, 37, that accepts the impression from the surface of 40, as seen in the fringe, 39, formed in the paper.

Figure 8:
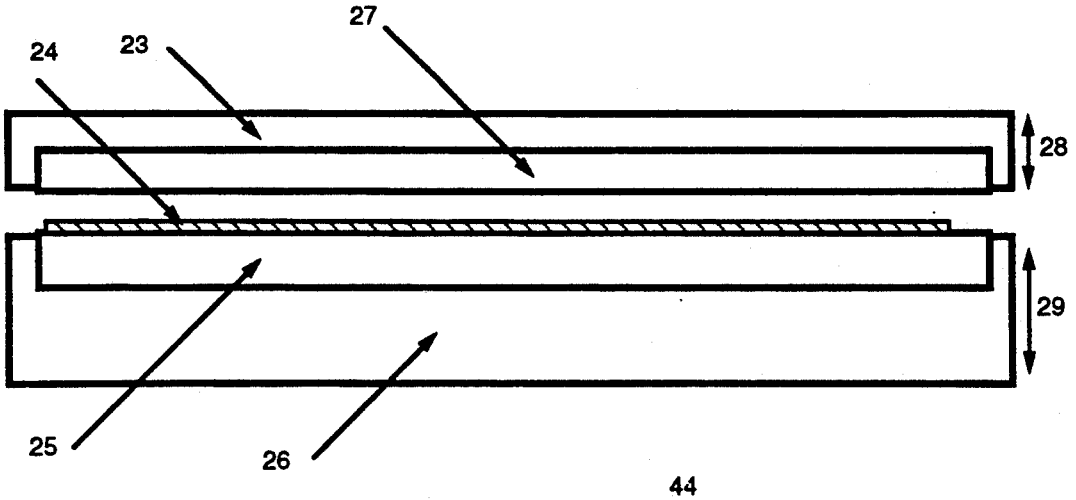
FIG. 8 is a schematic drawing of an alternative apparatus in the method of the invention.
Figure 9:
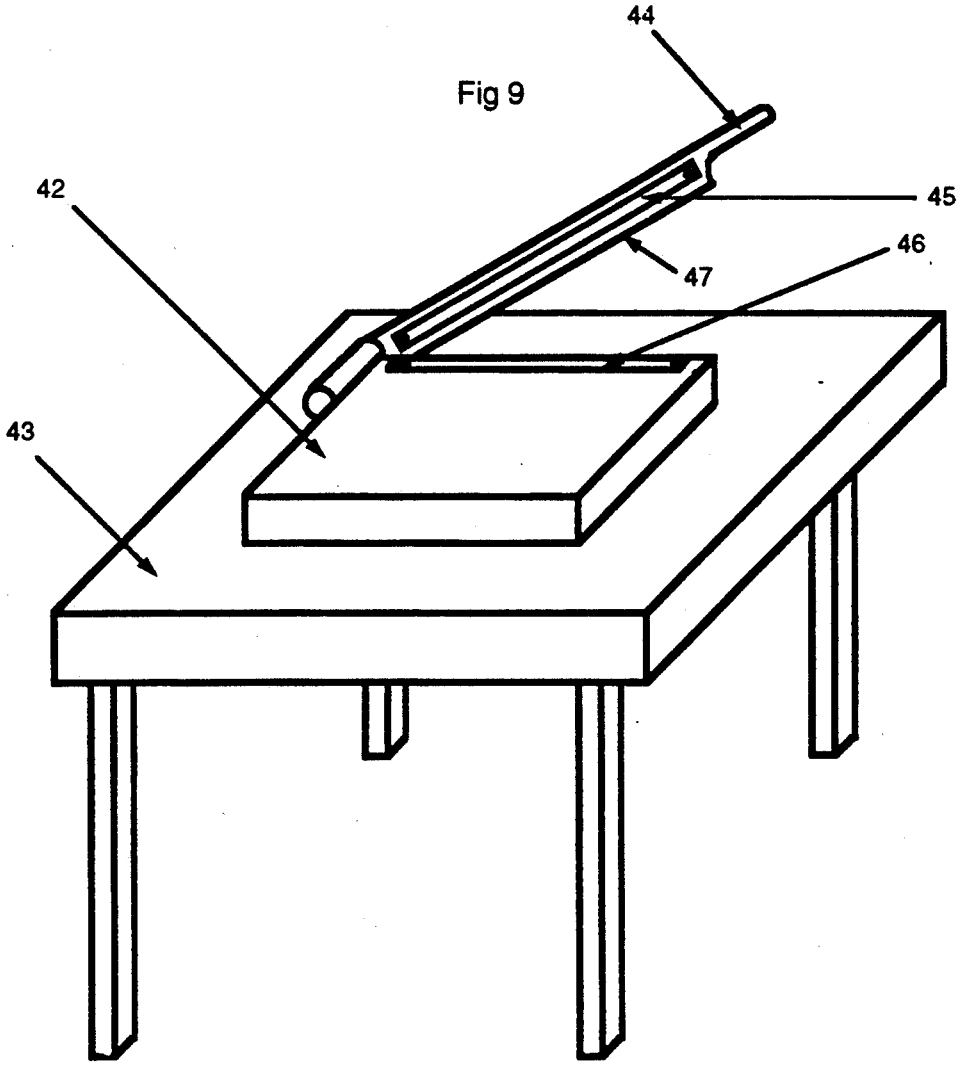
FIG. 9 is an example of a manual tool based on the apparatus in FIG. 8.

FIG. 8 shows another alternative apparatus that consists of two planar treatment members, 23 and 26, upon one of which is overlaid the edge of the paper, 24. Either one or both of the treatment members, 25 and 27, may be hard surfaced in order to form a fringe. Arrows, 28 and 29, indicate the motion that brings the paper into contact with the treatment members to form an embossed fringe. For example, as shown in FIG. 9, the familiar, swiveling, manual paper cutter, 42, (guillotine) could form a safety fringe by incorporating one treatment member, 45, as part of the cutting blade, 44, and a second treatment member, 46, in the base, directly behind the blade, 47. When a sheet of paper is trimmed, the two treatment members compress the edge of the paper and form a safety fringe.

Figure 5:
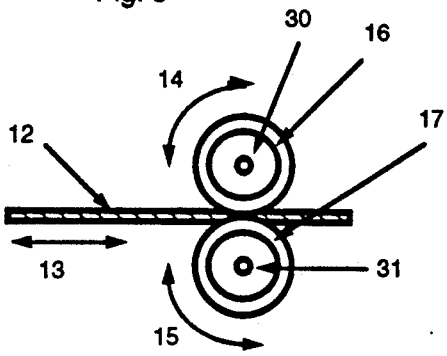
FIG. 5 is a schematic drawing illustrating apparatus that can be used in the method of the invention.

Treatment members 16 and 17 in FIG. 5; and members 18 and 19 in FIG. 6 can be familiar mechanical parts such as: splined, dimpled or knurled wheels, a variety of inside or outside, spur, bevel, hypoid, or other gear types, sanded or other grained (grinding) wheels; polishing wheels with wire-like or needle protrusions, a rack or flat surface 18 with a surface similar to the circular parts 19, 34 previously mentioned, which may mate with one of the previously mentioned circular members. At least one of the treatment surfaces must be hard. The second surface can be hard or soft. In the latter case, the soft member serves to receive the impression of the hard treatment member. Metal, wood, plastic, hard rubber and other materials can serve this purpose well, depending upon the effect and appearance to be achieved.

Figure 7:
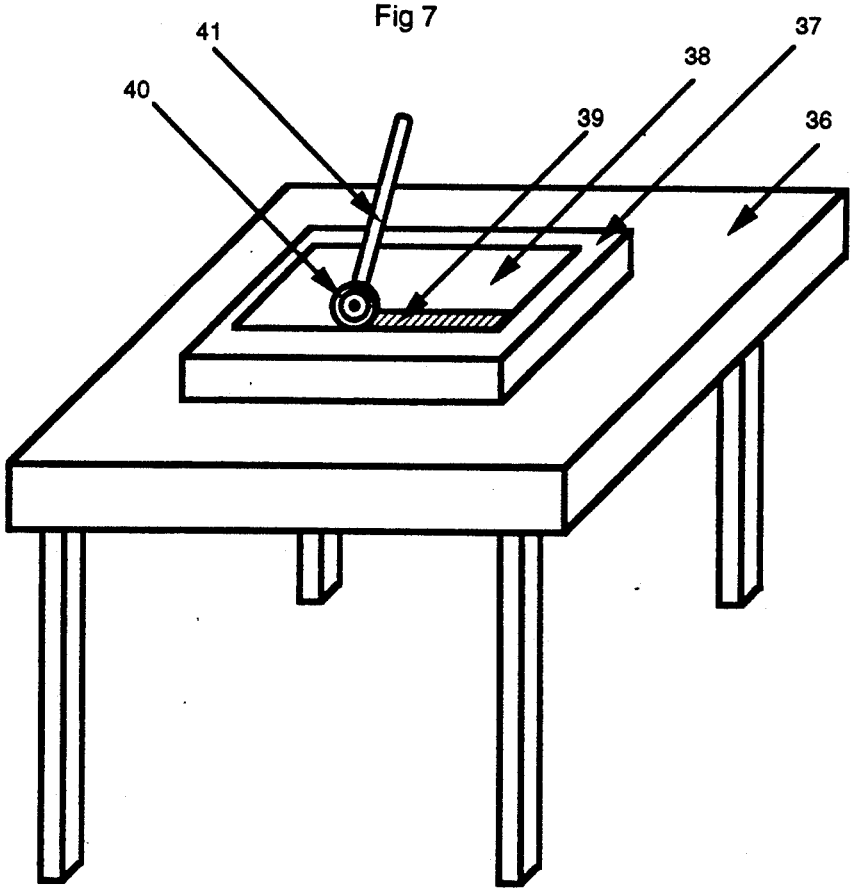
FIG. 7 is an example of a manual tool based on the apparatus in FIG. 6.

FIG. 9 illustrates the appearance of typical safety fringes that can be formed on paper with the alternative apparatus in FIGS. 6, 7 or 8:

a) dimpled, b)scalloped, c) slit, d) perforated.

Treatment to form a safety fringe can be applied when paper is produced at a mill, or after some cutting, printing, copying, corrugating, folding, gluing, or other processing has been performed. For example, it may be desirable to not form a fringe until after paper has passed through a machine, in order to prevent jamming. A safety fringe could be formed on a sheet of paper, as a final stage within a machine, in a separate piece of office equipment, or at any time before the paper is to be handled by people.

The use of safety fringes will have some secondary effects. A stack of paper sheets with fringes will stand higher then a stack without fringes. It will generally be easier to separate sheets of paper which have safety fringes, than sheets without fringes.

Safety fringes can be formed by submitting the edge of a paper product to a chemical, biological (enzymatic agent) or radiological exposure. Similarly, temperature and humidity cycling may also be used. The cost and hazards of some of these means, by comparison with the simple mechanical means described above, appears to make them less desirable. However, the use of means other than mechanical, at such time as technology reduces their risk and cost, would make their use to form a weakened safety fringe on paper products to prevent persons from receiving cuts, part of this invention.

As mentioned previously, there are other materials that cause skin cuts. The methods for forming safety fringes in the present invention apply to other, similar materials.

I claim:

1. A method for treating an outermost edge of a material in order to reduce the possibility that persons handling said material receive skin cuts, comprising the steps of:

a) moving the material to a treatment position, and b) at said treatment position, forming a safety fringe of weakened material, at said outermost edge, and to a small distance from that edge, wherein said small distance is done up to ¼" from that edge and depending upon the weight and stiffness of the material.

2. The method according to claim 1, wherein said treatment is applied to materials made of paper.

3. The method according to claim 1, wherein said treatment is a mechanical weakening of the material.

4. The method in claim 3, wherein treatment consists of bringing the material between the peripheries of two treatment members, at least one of which said members has a hard and protruding peripheral surface, and providing relative motion between the material and the members so that the material is crushed and deformed as it passes between the members.

5. The method in claim 4, wherein the edge of the material passes between the periphery of a pair of meshing, rotating circular members.

6. The method in claim 5, where said circular members are gears or knurling wheels or abrasive wheels.

7. The method in claim 4, wherein the edge of the material passes between the periphery of a rotating circular member and a meshing, planar rack member.

8. The method in claim 4, wherein the edge of the material is contacted by a pair of planar rack members.

9. The method in claim 4, wherein the surface of at least one member contains needle-like protrusions, so that the edge of the paper is perforated when it passes between the members.

10. The method in claim 4, wherein the surface of at least one of the members consists of masonry material with aggregate of selected size and coarseness.

11. The method according to claim 1, wherein said treatment is accomplished by contact of the outermost edge of the material with chemical agents.

12. A method for treating the edge of paper products to reduce the possibility of such products tearing the skin and injuring people, comprising the steps of:

a) moving the paper past a treatment position, and b) at said treatment position, treating the edge of the paper to weaken the structural strength thereof along the edge of the paper as it passes by said position, whereby, the edge of the paper so treated does not have the mechanical strength to support the sharp edge of the paper, and, so weakened, it is less likely to pierce or cut the skin of a person coming into contact with the paper.

* * * * *